US010464715B1

(12) United States Patent
DeJesus et al.

(10) Patent No.: US 10,464,715 B1
(45) Date of Patent: Nov. 5, 2019

(54) SEQUENTIAL GIFT TRAYS

(71) Applicants: Karen DeJesus, Rockledge, FL (US); Amanda Benson-Ehrie, Canton, GA (US)

(72) Inventors: Karen DeJesus, Rockledge, FL (US); Amanda Benson-Ehrie, Canton, GA (US)

( * ) Notice: Subject to any disclaimer, the term of this patent is extended or adjusted under 35 U.S.C. 154(b) by 119 days.

(21) Appl. No.: 15/829,309

(22) Filed: Dec. 1, 2017

Related U.S. Application Data

(60) Provisional application No. 62/434,776, filed on Dec. 15, 2016.

(51) Int. Cl.
*B65D 25/20* (2006.01)
*B65D 1/40* (2006.01)
*B65D 1/34* (2006.01)

(52) U.S. Cl.
CPC ..... *B65D 25/205* (2013.01); *B65D 1/34* (2013.01); *B65D 1/40* (2013.01)

(58) Field of Classification Search
USPC ..... 40/799
See application file for complete search history.

(56) References Cited

U.S. PATENT DOCUMENTS 6,599,131 B2 * 7/2003 Wolfson ..... G09B 19/00 40/775
6,688,029 B1 * 2/2004 Dunn ..... A47G 1/06 40/711
7,017,292 B1 * 3/2006 Abelarde ..... G09D 3/00 283/2
2008/0235095 A1 9/2008 Oles et al.
2009/0007467 A1 * 1/2009 Bowman ..... G09D 3/04 40/107
2009/0242455 A1 * 10/2009 Adams ..... B65D 5/4204 206/575
2009/0271253 A1 10/2009 Arazy et al.
2011/0101667 A1 5/2011 Alizieri et al.
2011/0251962 A1 10/2011 Hruska
2013/0275204 A1 10/2013 Wilen
2015/0213438 A1 7/2015 Kramer et al.
2016/0005028 A1 1/2016 Mayblum et al.
2017/0076276 A1 3/2017 Curtis

OTHER PUBLICATIONS

The Days of Gifts—How it works, https://web.archive.org/web/20151208190253/http://thedaysofgifts.com/how-it-works, 8 pages (Year: 2015).*

* cited by examiner

*Primary Examiner* — Kristina N Junge
(74) *Attorney, Agent, or Firm* — Brian S. Steinberger; Hilary F. Steinberger; Law Offices of Brian S. Steinberger, P.A.

(57) ABSTRACT

Kits, systems, devices, apparatus and methods for a sender to provide a novel distribution of gifts to a recipient, using a tray with removable small containers magnetically held to the tray, where the small containers store tags corresponding to separately wrapped gifts, where a recipient opens one small container per day which identifies a tag, which is then matched to an identical tag on a separate covered gift that when opened provides a unique present from the sender to the recipient, and where all the magnetic containers are opened sequentially one per day until all the small containers and the separately gifts have been opened to distribute the presents over a period of days, such as from a couple of days to 7 to 8 days or more.

7 Claims, 12 Drawing Sheets

Gifts in a Row
PC-3665 Recipient Instructions

| Step 1 | Step 2 | Step 3 | Step 4 |
|---|---|---|---|
| • Recipient will receive- Gift Tray, and designated number of presents from sender (min 4 to 7 or more). Recipient is not to open any boxes or gifts until the designated start date in receiver's instruction sheet. | • On the start date the recipient will pop off box labeled #1,open the box and look for the tag at the bottom of the box. | • Recipient will match the tag from the box to one of the presents he/she has received, open and enjoy. | • Receiver will follow the same process each day- opening only one present per day, until all boxes and gifts are gone. |

Sequential Gift Tray PC-3665

Gifts in a Row
PC-3665 Giver Instructions

| Step 1 | Step 2 | Step 3 | Step 4 |
|---|---|---|---|
| • Giver will provide the number of gifts to match the number of days requested for gift tray- Gifts can be purchased by receiver or through Gifts in a Row Website (min. of 4 to 7 or more gifts). | • Giver will arrange the gifts in order they want the recipient to open/ receive their gift each day. Starting with Day 1 through Day 7 or more. | • Giver will attach provided gift tags to each gift for each designated day the giver want the gifts to be opened.<br>• Example: 7 gift tags will be provided labeled Day 1- through Day 7.<br>• The giver will place gift tag labeled Day 1 on the gift that should be opened on day one. Giver will follow the same process for each day until all tags are gone. | • Giver will specify on the Recipients instruction sheet the start date in which the receiver is to open box labeled Day 1.<br>• Giver will be responsible for delivery if they purchased the Tray and their own gifts.<br>• If tray and gifts were purchased through Gifts in a Row Website they will be responsible for delivery. |

FIG.12

Gifts in a Row
PC-3665 Recipient Instructions

| Step 1 | Step 2 | Step 3 | Step 4 |
|---|---|---|---|
| • Recipient will receive- Gift Tray, and designated number of presents from sender (min 4 to 7 or more). Recipient is not to open any boxes or gifts until the designated start date in receiver's instruction sheet. | • On the start date the recipient will pop off box labeled #1,open the box and look for the tag at the bottom of the box. | • Recipient will match the tag from the box to one of the presents he/she has received, open and enjoy. | • Receiver will follow the same process each day- opening only one present per day, until all boxes and gifts are gone. |

FIG.13

Gifts in a Row
PC-3665 Gift Card Giver Instructions

| Step 1 | Step 2 | Step 3 | Step 4 |
|---|---|---|---|
| • Giver will need to purchase Gifts cards from Gifts in a Row Website. Giver must purchase enough Gift card to match the number of days requested for gift tray. (min. of 4 to 7 or more gifts). Givers choice of gift cards. | • Giver will need to print Gift card codes from Website and arrange Gift cards in order of which they want the recipient to open/receive each day. Starting with Day 1 through Day 7 or more. | • Giver will place Gift card code inside each gift box for each designated day the giver wants the gift card to be opened.<br>• Example: The giver chooses which gift card is to be opened on Day 1. The giver will place that code inside Box 1. Giver will follow the same process for each day until all Gift card codes have been used. | • Giver will specify on the Recipients instruction sheet the start date in which the receiver is to open box labeled Day 1.<br>• Giver will be responsible for delivery if they purchased the Tray and their own gifts.<br>• If tray and gifts were purchased through Gifts in a Row Website they will be responsible for delivery. |

FIG.14

Gifts in a Row
PC-3665 Gift Card Recipient Instructions

| Step 1 | Step 2 | Step 3 | Step 4 |
|---|---|---|---|
| • Recipient will receive- Gift Tray from Giver. Recipient is not to open any boxes until the designated start date on receiver's instruction sheet. | • On the start date the recipient will pop off box labeled #1,open the box and find Gift card code at the bottom of the box. | • Recipient will go to the Gifts in a Row Website, create account and enter code into Gift card redemption site to see their Gift card description and amount. | • Receiver will follow the same process each day- opening only one box per day until all boxes are opened. |

FIG.15

SEQUENTIAL GIFT TRAYS

This application claims the benefit of priority to U.S. Provisional Patent Application Ser. No. 62/434,776 filed Dec. 15, 2016, which is incorporated by reference in its' entirety.

FIELD OF INVENTION

This invention relates to kits, systems, devices, apparatus and methods for a sender to provide a novel distribution of gifts to a recipient, using a tray with removable small containers magnetically held to the tray, where the small containers store tags corresponding to matching tags on separately wrapped gifts, where a recipient opens one small container per day which identifies a tag which is then matched to an identical tag on a separately wrapped gift that when opened provides a unique present from the sender to the recipient, and where all the magnetic containers are opened sequentially one per day until all the small containers and the separately wrapped gifts have been opened to distribute the presents over a period of days, such as from a couple of days to 8 days or more.

BACKGROUND AND PRIOR ART

Holidays and special occasions are often celebrated by a gift giver providing a gift to a recipient, where joy occurs when the recipient rips open the gift to reveal a hidden present. Traditional holidays, such as Christmas and special days such as birthdays are often celebrated when the recipient is given several gifts at that one time from one gift giver. The joy can include the fun and excitement that occurs at the moment the recipient is surprised by the gift identify.

The joy of receiving the gifts can become as short as a few minutes when the recipient opens up all their gifts at relatively the same time. As such, both the gift giver and the gift recipient only look forward to that one time when all the gifts are opened. As such, the joy to both parties can be very short lived.

This short timeframe of enjoyment of the occasion can cause further disappointment when the gift giver has spent a great deal of time such as days, weeks and even months to shop and find the gifts to be given as well as the time it can take to wrap those gifts.

The gift receiver has little time to enjoy the surprises of the different gifts when they normally open all their gifts at once.

Because of the short amount of time to open the gifts, the recipient can easily forget the short-lived joy which also can become a fast let down when the memories fade.

Thus, the need exists for solutions to the above problems with the prior art.

SUMMARY OF THE INVENTION

A primary objective of the present invention is to provide kits, systems, devices, apparatus and methods to allow a sender to control and delay the distribution of a plurality of gifts to a recipient over a plurality of days up to seven or eight days.

A secondary objective of the present invention is to provide kits, systems, devices, apparatus and methods to allow a sender to extend the joy and excitement when providing gifts to a recipient for a holiday or special occasion, such as a birthday, and the like.

A third objective of the present invention is to provide kits, systems, devices, apparatus and methods to extend the memories of a sender giving gifts to a gift recipient A fourth objective of the present invention is to provide kits, systems, devices, apparatus and methods for using a tray with removable small containers releasably secured for example, by magnetics to the tray, where the small containers correspond to gifts, where a gift recipient opens one small container per day and where all the magnetic containers are opened sequentially one per day until all the small containers and gifts have been opened to distribute the presents over a period of days, such as from a couple of days to a week or more.

The small containers can store tags corresponding to the separately wrapped gifts, where a gift recipient opens one small container per day which identifies a tag, and which the gift recipient can match to a separately wrapped gift having the matching tag that when opened provides a unique present from the sender to the recipient, and where all the magnetic containers are opened sequentially one per day until all the gifts have been opened.

Further objects and advantages of this invention will be apparent from the following detailed description of the presently preferred embodiments which are illustrated schematically in the accompanying drawings.

BRIEF DESCRIPTION OF THE FIGURES

FIG. 12 is a flow chart of instructions for use with a gift giver to assemble the tray with small containers and gifts.

FIG. 13 is a flow chart of instructions for the recipient of the gifts.

FIG. 14 is a flow chart of instructions for a gift giver to purchase gift cards for gift recipient.

FIG. 15 is a flow chart of instructions for a gift recipient of the gift cards of FIG. 14.

DESCRIPTION OF THE PREFERRED EMBODIMENTS

Figure 1:
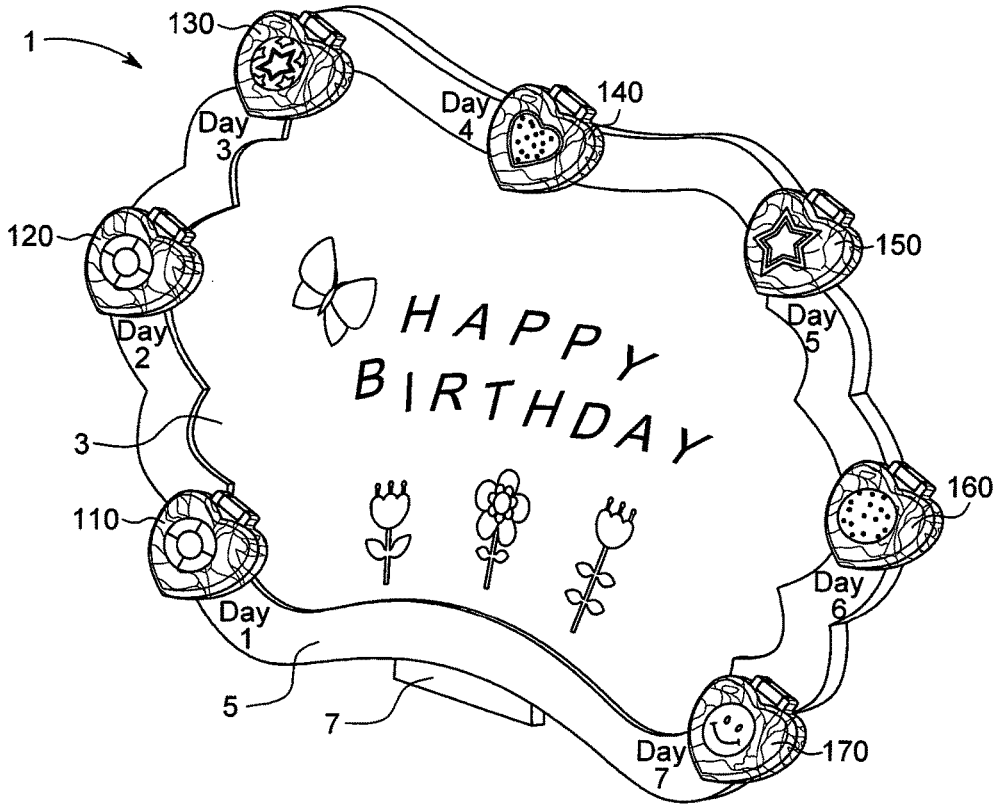
FIG. 1 is a perspective view of an assembled tray with small containers each holding gift numbers inside, with the containers attached to the tray by magnets, being used for a special occasion.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of the components referenced in the FIGURES is now described.

1. Assembled tray with magnetically attached small containers
3 base tray
5 frame on tray
7 foldable rear stand
8 base on stand
10 magnet for day 1
15 slot for magnet 10
20 magnet for day 2
25 slot for magnet 20
30 magnet for day 3
35 slot for magnet 30
40 magnet for day 4
45 slot for magnet 40
50 magnet for day 5
55 slot for magnet 50
60 magnet for day 6
65 slot for magnet 60
70 magnet for day 7
75 slot for magnet 70
110 small container for day 1
112 lid on small container
114 washer on back of small container
115 hinge
116 base of small container
117 paper filling
120 small container for day 2
130 small container for day 3
140 small container for day 4
150 small container for day 5
160 small container for day 6
170 small container for day 7
200 sheet of sequential labels
300 gifts with sequential labels thereon The novel invention covers kits, systems, devices, apparatus and methods to allow a gift sender/giver to control and delay the distribution of a plurality of gifts to a gift recipient/receiver over a plurality of days up to seven or eight days.

The gift senders/givers and gift recipients/receivers can include parents and grandparents and moms and dads, grandparents, neighbors, best friends, husbands to wives and brothers to sisters, employees to employers or just someone that the sender/giver knows that needs a little fun to cheer them up.

The gift sender/giver does not have to spend a lot of money. For example, a favorite candy or snack can be used for fun for one day! The gift sender/giver can use the occasion as a themed event, and can be purchased from a website for convenience. For example, Day one—coffee mug, Day two—special coffee next day, Day three—a gift card to DUNKIN DONUTS or STARBUCKS, Day four—a gas card to get there, Day five—a book to read, Day six—something sweet, Day seven—is normally the Big day—its been building up for SIX Days—they are ready for anything!

Table 1 lists some occasions, holidays and/or special events. However, there are always those special holidays like "No Pants Day", and the like that can also be added. And if you need someone to shop for you, we can do that too. Additionally, the Table 1 can be updated to meet requested religions, such as but not limited to Christian, Catholic, Jewish, Orthodox Jewish, Hindu, Muslim, and the like.

Table 1

| |
|---|
| Administrative Professional Day |
| Anniversary, such as weeding, work, friendship, and the like |
| Baby Welcome—Girl or Boy |
| Baby Shower |
| Back to school |
| Birthdays |
| Black Friday |
| Cancer Survivor |
| Chinese New Year |
| Christmas |
| Cinco de Mayo |
| Congratulations! |
| Easter |
| Employee Appreciation Day |
| Family Fun Week! |
| Father's Day |
| First Day of School |
| Friendship Day |
| Get Well. |
| Graduation |
| Grandparents Day |
| Happy New Years |
| Halloween |
| Hanukkah |
| Independence Day |
| July $4^{th}$ |
| Just because . . . . |
| Mardi Gras |
| Memorial Day |
| Miss you |
| Mother's day |
| National Freedom Day |
| New Years |
| National Nurses Day |
| Read Across America Day |
| Sweethearts Day |
| St. Patrick's Day |
| Veterans Day |
| Thanksgiving |
| Valentine's Day |
| Veterans Day |

Figure 2:
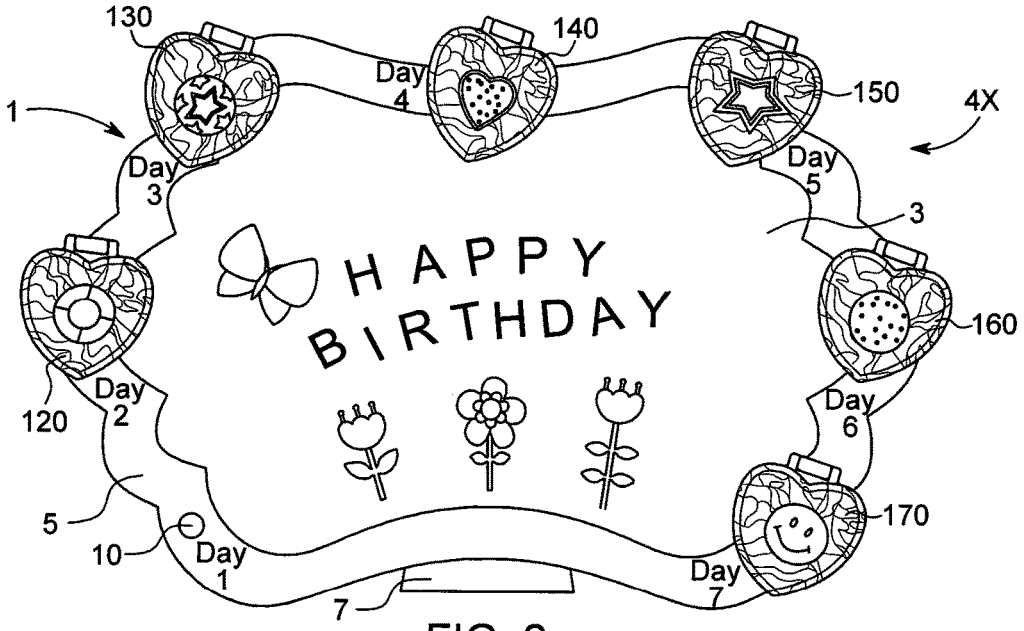
FIG. 2 is a front view of the assembled tray with small containers of FIG. 1.
Figure 3:
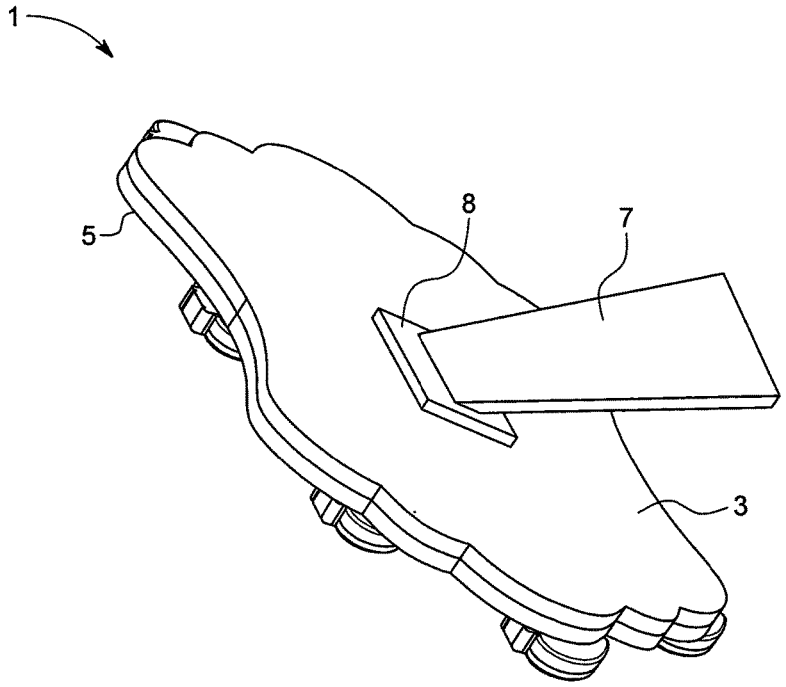
FIG. 3 is a rear perspective view of the assembled tray with small containers of FIGS. 1-2.

FIG. 1 is a perspective view of an assembled tray 1 with small containers 110, 120, 130, 140, 150, 160, 170 each holding gift numbers inside, with the containers 110-170 attached to the frame 5 on the tray base 3 by magnets, being used for a special occasion. FIG. 2 is a front view of the assembled tray with small containers of FIG. 1. FIG. 3 is a rear perspective view of the assembled tray 1 with attached small containers 110-170 of FIGS. 1-2.

Figure 4:
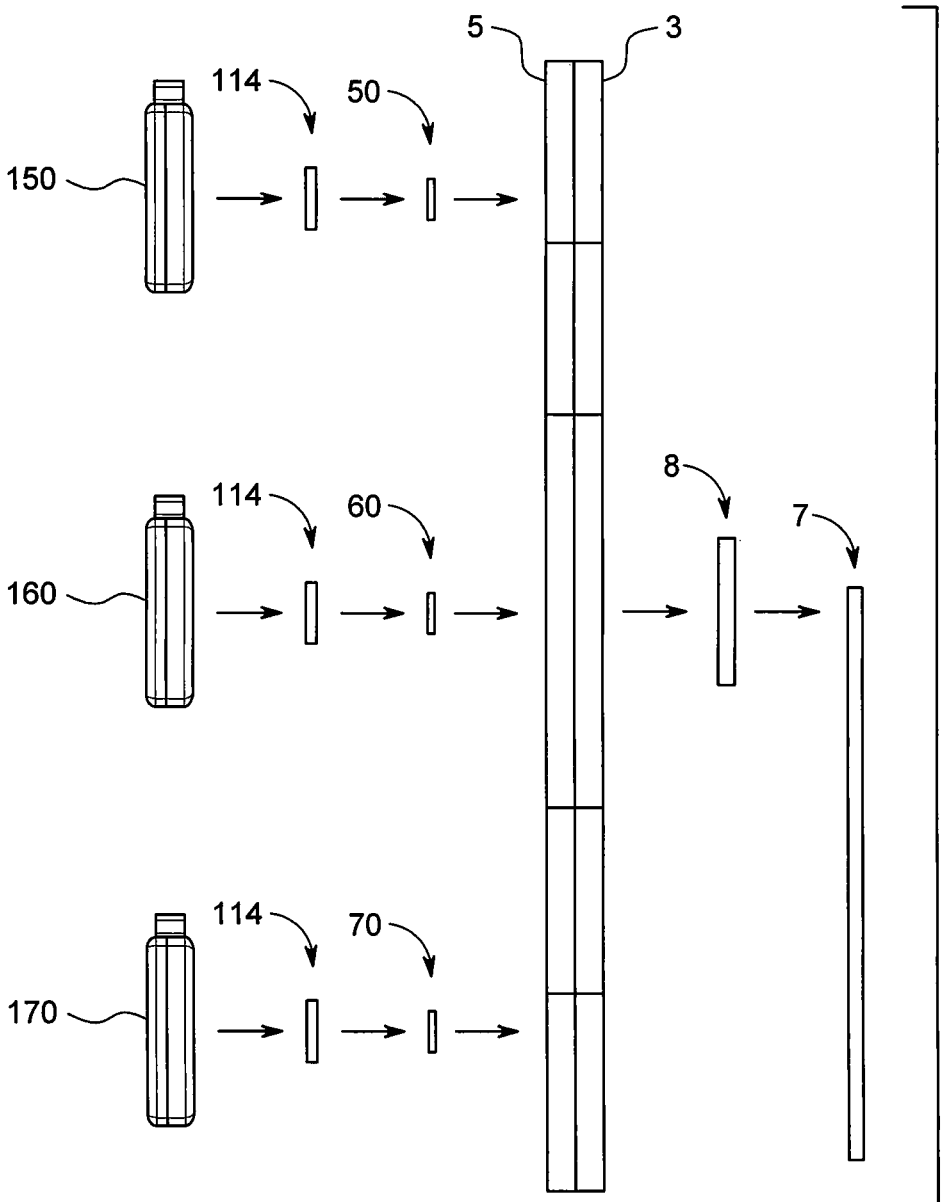
FIG. 4 is a side exploded view of the assembled tray of FIGS. 1-3 with small containers separated from the tray.

FIG. 4 is a side exploded view of the frame 5 on the base tray 3 of FIGS. 1-3 with small containers 150, 160, 170 separated from the frame 5 on the base tray 3. The foldable rear stand 7 is also separated from the stand base 8.

Figure 5:
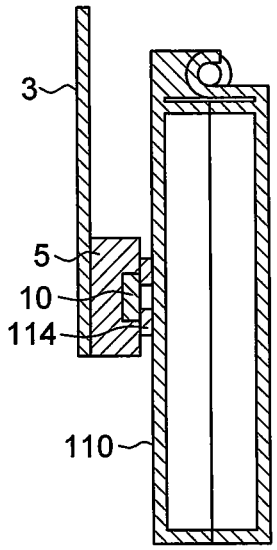
FIG. 5 is an enlarged side cross-sectional view of a single small container attached to the tray of FIGS. 1-3.

FIG. 5 is an enlarged side cross-sectional view of a single small container 110 attached to the frame 5 on the base tray 3 of FIGS. 1-3, showing the magnet 10, washer 114 on back of the small container 110.

Figure 6:
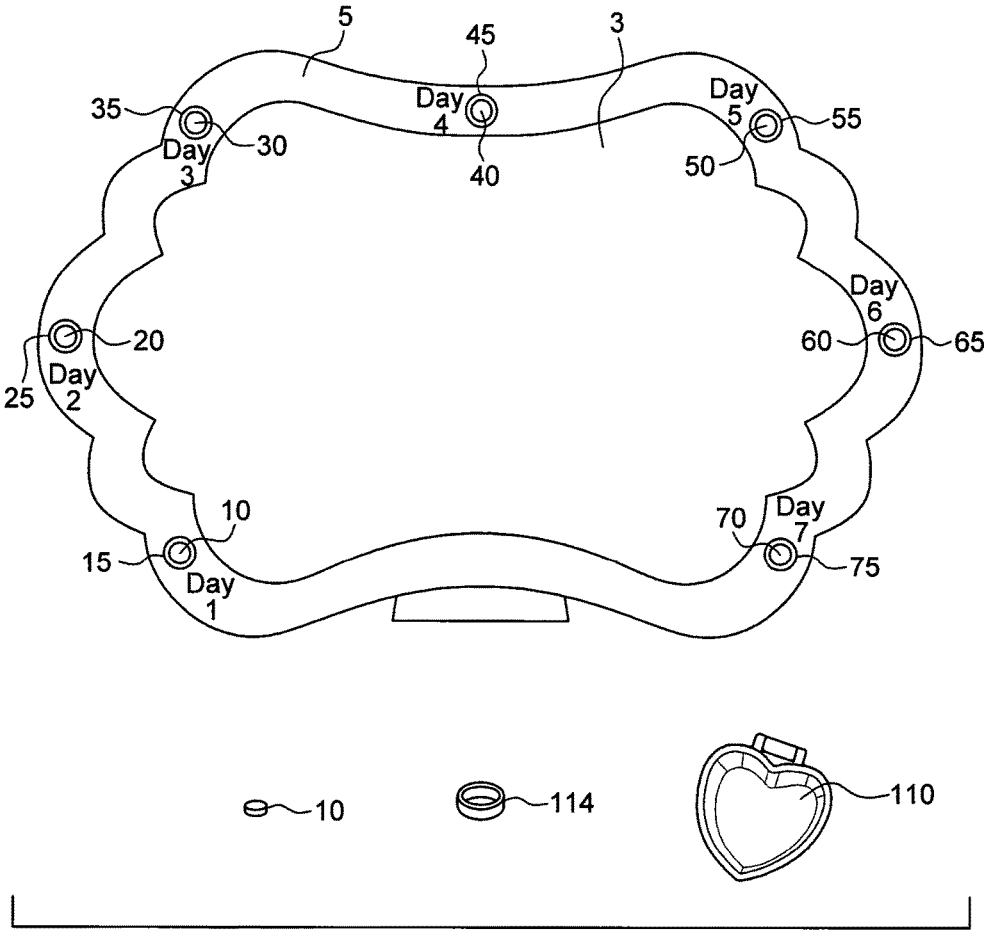
FIG. 6 is an exploded view of the tray and one of the small containers of the preceding FIGURES with a washer and small magnet.

FIG. 6 is an exploded view of the frame 5 on base tray 3 showing each of the magnets 10, 20, 30, 40, 50, 60, 70 imbedded into respective slots 15, 25, 35, 45, 55, 65, 75 on the frame 5, along with one of the small containers 110 of the preceding FIGURES with a washer 114 and small magnet 10.

Figure 7:
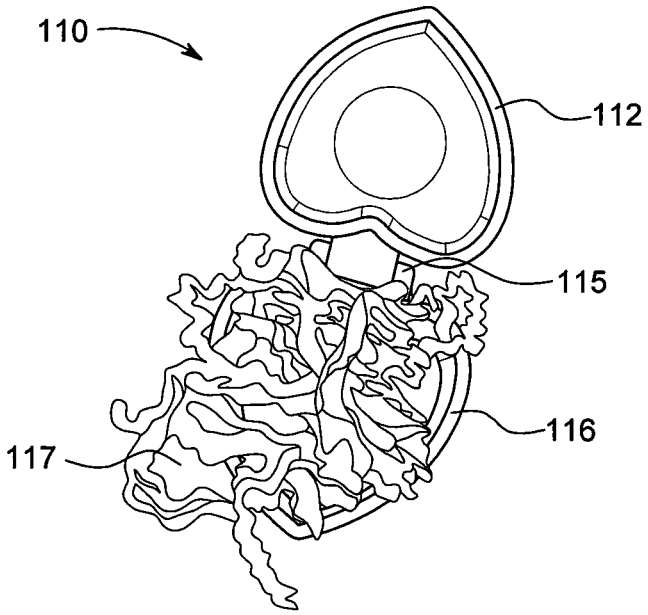
FIG. 7 is an enlarged front view of the small container of FIG. 6 being opened with paper stuffing inside.
Figure 8:
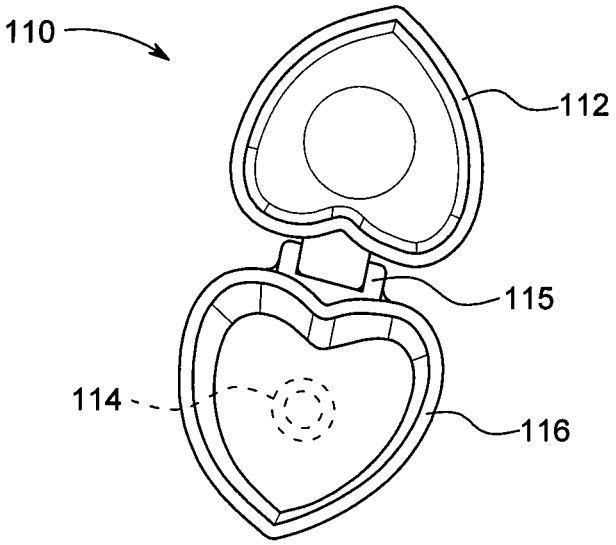
FIG. 8 is another view of the opened small container of FIG. 7 without the paper stuffing.

FIG. 7 is an enlarged front view of the small container 110 of FIG. 6 being opened with paper stuffing 117 inside. FIG. 8 is another view of the opened small container 110 of FIG. 7 without the paper stuffing 117. The small container 110 can have a lid 112 that opens by a hinge 115 that is connected to a base 116.

Figure 9:
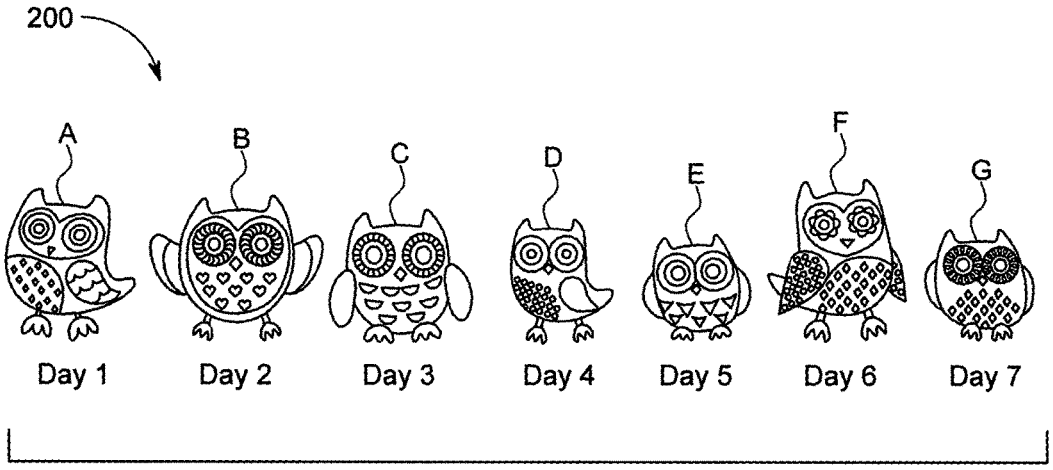
FIG. 9 is a sheet of removable labels of sequential numbers for use with the gifts to match the numbers on the containers on the tray of FIG. 1.

FIG. 9 is a sheet 200 of removable labels A, B, C, D, E, F, G, of sequential numbers for use with the gifts to match the numbers on the containers on the assembled tray 1 of FIG. 1.

Figure 10:
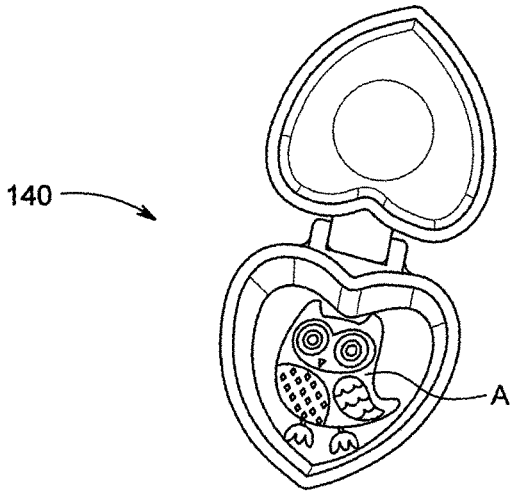
FIG. 10 is another view of the opened container of FIGS. 7-8 with one of the labels from the sheet of FIG. 9 therein.

FIG. 10 is another view of the opened container 140 of FIGS. 7-8 with one A of the labels from the sheet 200 of FIG. 9 therein.

Figure 11:
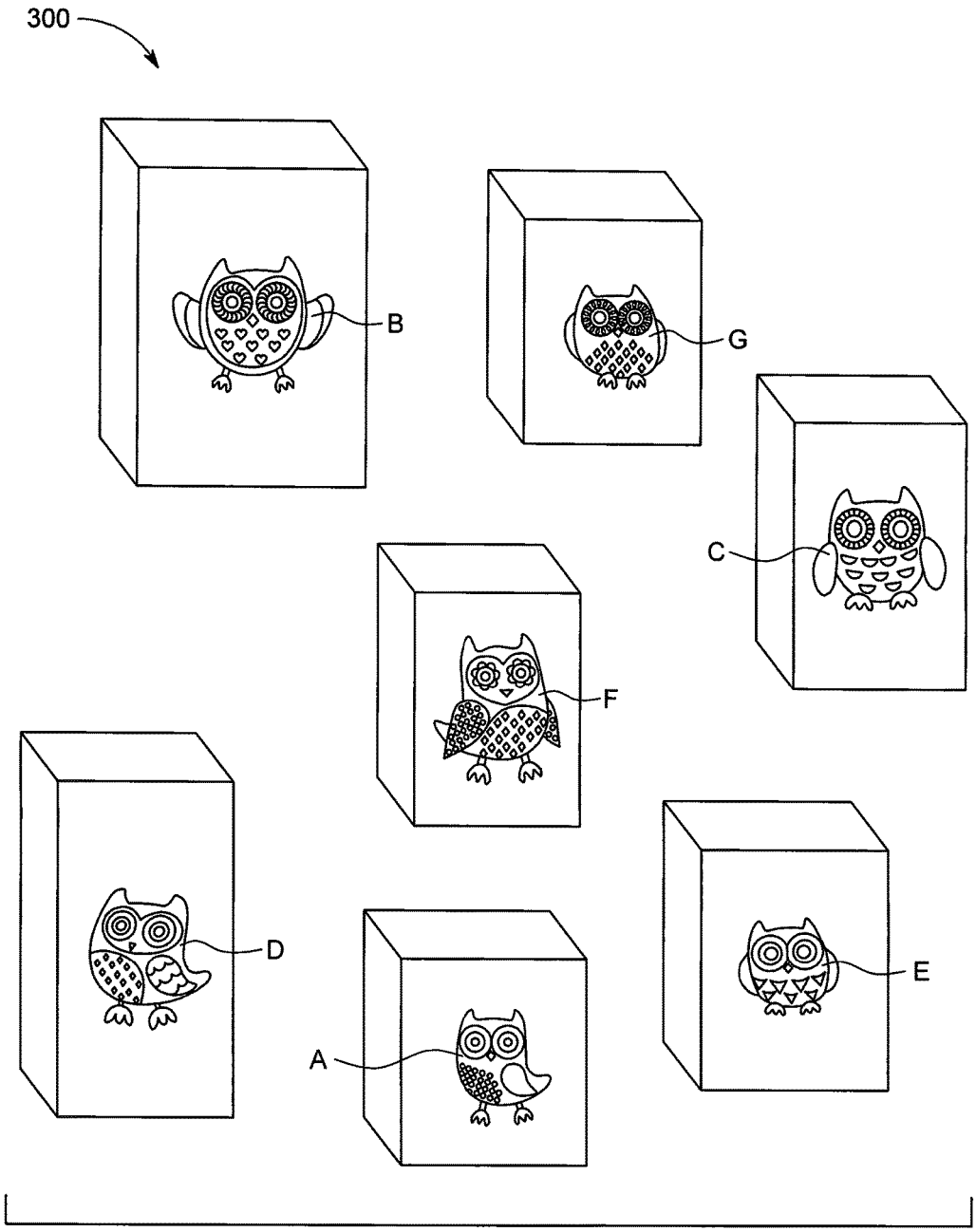
FIG. 11 shows a view of wrapped presents with each of the labels of FIG. 10 placed thereon.

FIG. 11 shows a view of wrapped presents 300 with each of the labels A-G of FIG. 10 placed thereon.

Referring to FIGS. 1-11, the invention can be provided in a kit form, for purchase by a gift sender/sender. The kit can include but not be limited to a gift tray with frame 5 on base tray 3 that can be laid on its back in a horizontal orientation, or in a generally vertical orientation with the foldable stand 7, where the stand 7 can allow the tray to be generally upright. The frame 5 on the base tray 3 can include a plurality of metal portions/magnets 10, 70 about a perimeter of the frame 5 having a central portion across the front of the tray base 3 theme that celebrates a holiday, special occasion, and the like.

A plurality of small decorative gift containers 110-170 such as heart shaped containers adorned with designs, artwork, and the like, can be magnetically attached to each of the magnets/metal portions 10-70 on the frame 5 of the base tray 3. Each of the containers 110-170 can be numbered and the containers 110-170 can be arranged in a sequential configuration from 3-4 up to 7-8 about the frame 5 on the base tray 3, with metal/magnet back washer portions 15 (one is shown) that attract to the metal portions/magnets 10-70 on the frame 5 of the base tray 3.

The kit can also include a sheet 200 of removable labels A-G of sequential numbers for use with the gifts 300 to match the containers 110-150.

The gift sender/giver is responsible for making a like number of a plurality of gifts 300 that can be separately wrapped and/or placed in gift bags and/or placed in gift envelopes and the like. The actual wrapped gifts can be anything that the give giver wishes to have wrapped for the gift recipient.

FIG. 12 is a flow chart of instructions for use with a gift giver to assemble the tray with small containers and gifts.

Gift Sender/Giver Instructions

The following information can be provided to the gift sender/giver with the kit.

Congratulations on your purchase! This is really going to make someone's special occasion really special and fun! No more opening all the gifts in 10 minutes and forgetting what they got. Now they are going to think of you for seven straight days, and look forward to opening a gift a day!!

Your kit comes with everything you need, but the gifts!

Step one—You will need a minimum of 4 to 8 or more gifts wrapped and ready to go depending on the gift tray you purchased. We have enclosed gift bags in case you need it for some of the smaller gifts.

4 Days=4 gifts or 7 Days=7 gifts

Step two—inside your kit you will see a sheet of paper labeled—

Day 1 through Day 7 with a gift tag under each specific day. This is where you get to plan the fun. You choose which present you want them to open each day . . . . So, on Day one, you will take the gift tag labeled "Day One" off the sheet of paper and you put it on the present you want them to open on Day One—then you go to the tag for Day Two, whichever present you want them to open on Day Two—you place the gift tag on your wrapped present . . . you do the same thing for all days. Inside each of the boxes, we already put the matching tag for them to find.

Step three—Fill in the start date on the recipient's instructions, so they will know when they get to start their fun!

Step Four—Deliver or mail to recipient!

The gift receiver/recipient can be provided with the assembled tray with removable numbered small containers that can be mounted to the tray by magnets, along with a plurality of like numbered gifts.

The small containers can be labeled from 1 to 7, for example, to cover the different days of the week that the gifts are to be distributed.

A pair of unique tags can be used for each of the containers and gifts. The tags can be numbers and/or letters and/or symbols, and the like. Symbols can be used for the different holidays and different events. For example, the Christmas symbols can include Christmas trees, presents with bows, ornaments, candy canes, and characters, such as but not limited to Santa Clause, reindeers, sleds, snowman, and the like.

The sender/giver will place one of the pair of tags inside one container, and attach the matching (identical) tag to the outside of the present.

The sender/giver chooses which presents are to be opened in succession on the different days by controlling which tags are connected to each container and present.

After the tray with magnetically attached containers and covered presents are delivered to the recipient/receiver, the gift distribution will begin on the first day. The covered presents can be gift wrapped, placed in gift bags, placed in envelopes and the like. The recipient/receiver only learns what present they receive one day at a time, and is intended to be totally surprised when the present(s) are first opened.

On the first day, the recipient/receiver removes the first day labelled magnetically attached container from the tray, and opens the first container. Inside of the container is a tag. Next, the recipient/receiver goes to the group of presents and finds the present with an identical tag. The recipient/receiver then opens the present with the matching tag.

On day two, recipient/receiver removes the second day labelled magnetically attached container from the tray, and opens second day container, to remove another tag. Next, the recipient/receiver goes to the group of presents and finds the present with an identical tag. The recipient/receiver then opens the second day present with the matching tag. On each subsequent day, the next sequentially labelled container is removed from the tray and opened. And the recipient/receiver then opens the present with the matching tag, and the process is repeated until all of the labelled containers have been removed and opened, and the presents are distributed and opened.

FIG. 13 is a flow chart of instructions for the recipient of the gifts.

Distribution of the Presents/Gifts Between the Sender/Giver and Recipient/Receiver Gift Recipient/Receiver Instructions The gift recipient/receiver can receive instructions with the assembled kit which will now be described.

Congratulations on your special occasion, someone really wants you to enjoy your special occasion for longer than a day! Take your time with the instructions and get ready to have fun!

Instructions: Take your gifting tray out of box and carefully place in on a counter or if it is a hanging tray, you can hang it on a wall. Also Inside the box you will see 4 to 8 or more little boxes and on each box, is a number. They are numbered 1 through 4 or 1 through 7, depending on the number of days in your tray. Place the boxes on your tray with the magnets, they will pop right on . . . you can put them in order from 1-7 or put them in any order you would like ☺ they will pop right on. Then take all your wrapped presents out of the box and set them near your Gifting Tray.

Okay you are almost ready . . . . Remember you will need to pay attention to the numbers on the little boxes. You will only open one box per day for the next 4-7 days, and you can open it at any time that day or night No peeking! Your start date is _____

(The person that sent this to you chose this date, be patient, it's worth the wait ☺ )

Day #1 is here! Here is what you do:

FIND BOX #1 on your gifting tray.

Day 1—Pop off box labeled #1 from your tray, gently open the lid, and carefully pull out the paper. At the bottom of the box you will see a gift tag. You don't have to take the tag out, just match the gift tag to one of the wrapped presents. Once you find the present that matches—that is your special present for the day! Open and enjoy . . . .

(You can put the paper back in the box, tape the box back up and pop back on your tray!)

Remember . . . no peaking, only one box per day!

Day 2—follow same steps as Day 1 except pop off box labeled #2 match and open!

Day 3—follow the same steps and open box #3

Day 4—open box #4—open and enjoy!

Day 5—open box #5—open and enjoy!

Day 6—open box #6—open and enjoy!

Day 7—open box #7—open and enjoy!

We hope you enjoyed your special occasion!

Your Gifting tray is something you can keep for a long time and enjoy the memories!

If you have a family or someone that you want to celebrate his or her special occasion and to make them smile, please visit our Website Gifts-in-a-Row.com and make someone else's special occasion last more than just a day!

If your occasion is not listed, don't worry—any holiday you can think of, We will make it Special The covered gifts can be wrapped presents, gifts in gift bags and gifts in envelopes, such as but not limited to gift cards, coupons, and the like.

While the preferred embodiment uses a plurality of containers with sequential numbers for identifying which container to be opened for different days, the invention can use other types of sequential symbols, as but not limited to letters that can include A, B, C, D etc.

Although a preferred embodiment of the novel tray and magnetically attached small containers and labels can be used for seven (7) days (which is over the course of a week), the invention can be used with less numbers or more numbers as desired.

While the embodiments cover magnetically attached containers, the containers can be removably attached to the trays by other types of fasteners, such as but not limited to metal slugs, hooks, glue, buttons, hook and loop fasteners (VELCRO), snaps, and the like.

Although the identified embodiments use containers attached to trays, the invention can be web-based. For example, the kits can be purchased from a website, were a sender/receiver sends a sequential gift tray program to a recipient/receiver. The recipient/receiver can down load the program to their desktop, portable computer, smart phone and the like. On each day, the recipient/receiver can be directed to pull an image of a removable container from an image of a tray, with the recipient/receiver opening the first day container to identify a tag, followed by the recipient/receiver finding the covered gift image with the matching tag, and only being able to open that gift on that day. On each following day the next sequentially labelled container can be removed, another tag found inside that container, and then is matched up to the identical tag on another covered gift, and this continues on each subsequent day until all the containers have been removed and opened and all the presents have been opened so that the gift giving continues over different subsequent days.

A smart phone application can allow for the gift recipient/receiver to be photographed and/or video recorded to see their reactions and the pictures and/or video shared to the sender/giver.

A web based application of the invention can be used with web based gift card providers that can provide any type of goods and/or services, and/or with web based retail businesses, such as AMAZON, and the like, as well as brick and mortar stores, such as WALMART, TARGET, and the like.

FIG. 14 is a flow chart of instructions for a gift giver to purchase gift cards for gift recipient.

FIG. 15 is a flow chart of instructions for a gift recipient of the gift cards of FIG. 14.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method of distributing gifts over different days from a gift sender to a gift recipient, comprising the steps of:

providing a tray having a support surface;

providing a plurality of containers;

labelling each of the containers with a single sequential number, sequential number correlating to separate sequential days;

providing a plurality of magnets for attaching each of the sequential containers to the support surface of the tray;

providing a plurality of pairs of matching tags, each pair of matching tags being different from other pairs of matching tags; and providing a plurality of covered gifts, each of the gifts for holding a unique present therein, each of the plurality of covered gifts having one of the pair of matching tags attached;

placing another of the pair of matching tags inside each of the containers;

removing a first day sequentially labelled container from the tray;

opening the first day sequentially labelled container, to identify a first tag of a first matched pair of tag;

identifying a covered gift associated with a second tag of the first matched pair of tags, and opening the covered gift associated with the second tag; and continuing the removing of sequentially labelled containers followed by opening of the sequentially labelled containers and matching tags to presents on each subsequent day until all labelled containers are removed from the tray and all of the gifts are opened.

2. The method of claim 1, further comprising the step of: providing the tags include pairs of matching numbers.

3. The method of claim 1, further comprising the step of: providing the tags include pairs of matching letters.

4. The method of claim 1, further comprising the step of: providing the tags include pairs of matching symbols.

5. The method of claim 1, further comprising the step of: providing the covered gifts include a wrapped present.

6. The method of claim 1, further comprising the step of: providing the covered gifts include a gift bag with a present.

7. The method of claim 1, further comprising the step of: providing the covered gifts include a gift envelope with a present.

* * * * *